US005296829A

United States Patent [19]

Kothmann et al.

[11] Patent Number: 5,296,829

[45] Date of Patent: Mar. 22, 1994

[54] CORE-FORM TRANSFORMER WITH LIQUID COOLANT FLOW DIVERSION BANDS

[75] Inventors: Richard E. Kothmann, Pittsburgh; Donald K. Whirlow, Murrysville, both of Pa.

[73] Assignee: Electric Power Research Institute, Inc., Palo Alto, Calif.

[21] Appl. No.: 980,765

[22] Filed: Nov. 24, 1992

[51] Int. Cl.[5] ..... H01F 27/10

[52] U.S. Cl. ..... 336/60; 336/185

[58] Field of Search ..... 336/55, 58, 60, 185

[56] References Cited

U.S. PATENT DOCUMENTS

| | | | |
|---|---|---|---|
| 3,548,354 | 12/1970 | Schwab | 336/60 |
| 3,602,857 | 8/1971 | Bohin | 336/60 |
| 3,902,146 | 8/1975 | Muralidharan | 336/60 |
| 4,000,482 | 12/1976 | Staub et al. | 336/60 |
| 4,028,653 | 6/1977 | Carlsson et al. | 336/60 |
| 4,207,550 | 6/1980 | Daikoka et al. | 336/60 |
| 4,363,012 | 12/1982 | Daikoku et al. | 336/60 |

FOREIGN PATENT DOCUMENTS

| | | | |
|---|---|---|---|
| 52-28618 | 3/1977 | Japan | 336/60 |
| 55-22870 | 2/1980 | Japan | 336/60 |
| 55-71011 | 5/1980 | Japan | 336/60 |
| 61-219119 | 9/1986 | Japan | 336/60 |
| 1-313913 | 12/1989 | Japan | 336/60 |
| 2-49408 | 2/1990 | Japan | 336/60 |

*Primary Examiner*—Thomas J. Kozma

*Attorney, Agent, or Firm*—Flehr, Hohbach, Test, Albritton & Herbert

[57] ABSTRACT

A core-form transformer winding with liquid coolant flow diversion bands is disclosed. The apparatus includes a winding tube with a central longitudinal axis. A number of coil sections are axially displaced along the central longitudinal axis of the winding tube. Radial ducts are formed between the coil sections. Internal vertical ducts are formed within each of the coil sections. A liquid coolant is used to cool the windings during operation. Flow diversion bands are placed around every other coil section. The flow diversion bands generate a partial blockage of the liquid coolant, which produces a radial flow into one or more of the radial ducts, resulting in vertical flow through the internal vertical ducts.

9 Claims, 6 Drawing Sheets

CORE-FORM TRANSFORMER WITH LIQUID COOLANT FLOW DIVERSION BANDS

BRIEF DESCRIPTION OF THE INVENTION

This invention generally relates to the cooling of core-form transformers,, More particularly, this invention relates to a core-form transformer which controls liquid coolant flow with flow diversion bands positioned near the outer circumference of the transformer windings.

BACKGROUND OF THE INVENTION

Transformers are used to change the characteristics of an alternating current, for example, by changing the voltage magnitude, current magnitude, or phase angle of the alternating current. Transformers include a first multi-turn coil winding in close proximity to a second multi-turn coil winding. The alternating current in the first coil induces magnetic flux in a magnetic core. The magnetic flux then induces an alternating current, with new electrical characteristics, in the second coil.

Core-form transformers are known in the art. For a three-phase core-form transformer, the core includes three legs connected by yokes. Each of the core legs has a core-form winding positioned around it. The core and windings are then placed in a tank which includes openings for electrical connections to the windings. The openings are also used to position cooling equipment.

Operation of a transformer results in the generation of heat. A variety of techniques are used to remove heat from a transformer. A low power transformer may be self-cooling, while a medium power transformer may require a fan for cooling. Large capacity power transformers generally rely upon liquid cooling. That is, liquid is forced through the windings to remove heat, and the liquid is then cooled at a heat exchanger. Oil is a typical cooling liquid used in transformers. The heat exchanger is typically a fan-cooled finned tube. A pump circulates the oil through the transformer and heat exchanger.

FIG. 1 is a perspective view of a section of a prior art core-form transformer winding 20. The winding 20 includes a winding tube 22. A conductor is wound around the tube 22 to form coil segments 24A and 24B, which form a coil section 26. The coil segments 24A and 24B are radially displaced from one another by duct spacers 28. The duct spacers 28 result in internal vertical ducts 30 along the length of the transformer winding 20. The winding 20 also includes radial spacers 32. The radial spacers 32 vertically separate each coil section 26.

In a complete winding, a new coil segment 24C (not shown) would be formed over duct spacers 28C. In a similar manner, a number of coil segments would be formed.

FIG. 2 is an enlarged perspective view of a segment of the core-form transformer winding of FIG. 1. FIG. 2 depicts coil segments 24A and 24B being radially displaced from one another by duct spacers 28. The coil section 26A is vertically separated from coil section 26B by a radial spacer 32.

FIG. 2 only depicts two coil segments 24A and 24B, an actual winding would have several more coil segments, with duct spacers 28 between each segment. Thus, it should be appreciated that a number of coil segments will be interposed between coil segment 24B and the outer end 33 of the radial spacer 32. The outer end 33 of the radial spacer 32 includes a notch 35 which receives an outer vertical spacer 37. The outer vertical spacer 37 extends the entire length of the winding 20. An inner vertical spacer 39 is positioned between the tube 22 and the coil segment 24A. The inner vertical spacer 39 extends the entire length of the winding.

FIG. 3 is a cross-sectional view of the transformer winding 20 taken along the line 3—3 of FIG. 1. The figure reflects that the transformer winding 20 includes a number of coil segments 24A, 24B, and additional segments indicated by the dots. These coil segments form a number of coil sections 26A, 26B, etc. Each coil segment 24 is formed from a conductor 41 which is wound around the winding tube 22. The duct spacers 28 (not shown) between coil segments result in internal vertical ducts 30. Similarly, the radial spacers (not shown) result in radial ducts 45. The inner vertical spacer (not shown) forms an inner vertical duct 49 and the outer vertical spacer (not shown) forms an outer vertical duct 51. The winding 20 is enclosed by an outer wrap 52.

A liquid coolant is forced from the bottom of the winding 20 (the bottom of the page), to the top of the winding. To obtain favorable flow conditions within the winding, prior art windings include one or more radial barriers 47. By alternately blocking the flow path of the coolant, the barriers force the coolant to flow back and forth, or in a zig-zag fashion, as the coolant is forced from the bottom to the top of the winding 20.

There are a number of problems associated with the radial barriers 47 used in the prior art. First, the hydrodynamics of the back and forth flow prevents uniform distribution to the radial ducts 45. This phenomenon results from the fact that the coolant takes the path of least resistance, which means that the coolant will travel through the inner vertical duct 49 and the outer vertical duct 51, instead of altering its direction through the radial ducts 45. To remedy this problem, it is necessary to increase the pressure of the coolant entering the winding. Thus, there is high pressure at the bottom of the winding, this pressure decreases through frictional effects within the winding until the pressure at the top of the winding is very low. Thus, there is a problematic pressure drop from the bottom of the winding to the top of the winding. A high pressure drop reduces oil circulation and thereby increases the winding temperature.

It is expensive to install the prior art radial barriers 47. Installation requires the hand fitting of washer-shaped pieces into a large number of notches formed on the radial spacers 32. The notches require precise machining.

OBJECTS AND SUMMARY OF THE INVENTION

It is a general object of the present invention to provide a core-form transformer with liquid coolant flow diversion bands for improved liquid coolant distribution.

It is another object of the invention to provide improved liquid coolant radial flow within a core-form transformer winding.

It is still another object of the invention to provide a liquid cooled core-form transformer with reduced pressure drop.

It is another object of the invention to provide a relatively inexpensive and easily installed liquid coolant flow diversion apparatus for use in a core-form transformer winding.

These and other objects are obtained by a core-form transformer winding with liquid coolant flow diversion bands in accordance with the invention. The apparatus includes a winding tube with a central longitudinal axis. A number of coil sections are axially displaced along the central longitudinal axis of the winding tube. Radial ducts are formed between the coil sections. Internal vertical ducts are formed within each of the coil sections. A liquid coolant is used to cool the windings during operation. Flow diversion bands are placed around every other coil section. The flow diversion bands generate a partial blockage of the liquid coolant, which produces a radial flow into one or more of the radial ducts, resulting in vertical flow through the internal vertical ducts.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION OF THE INVENTION

Figure 1:
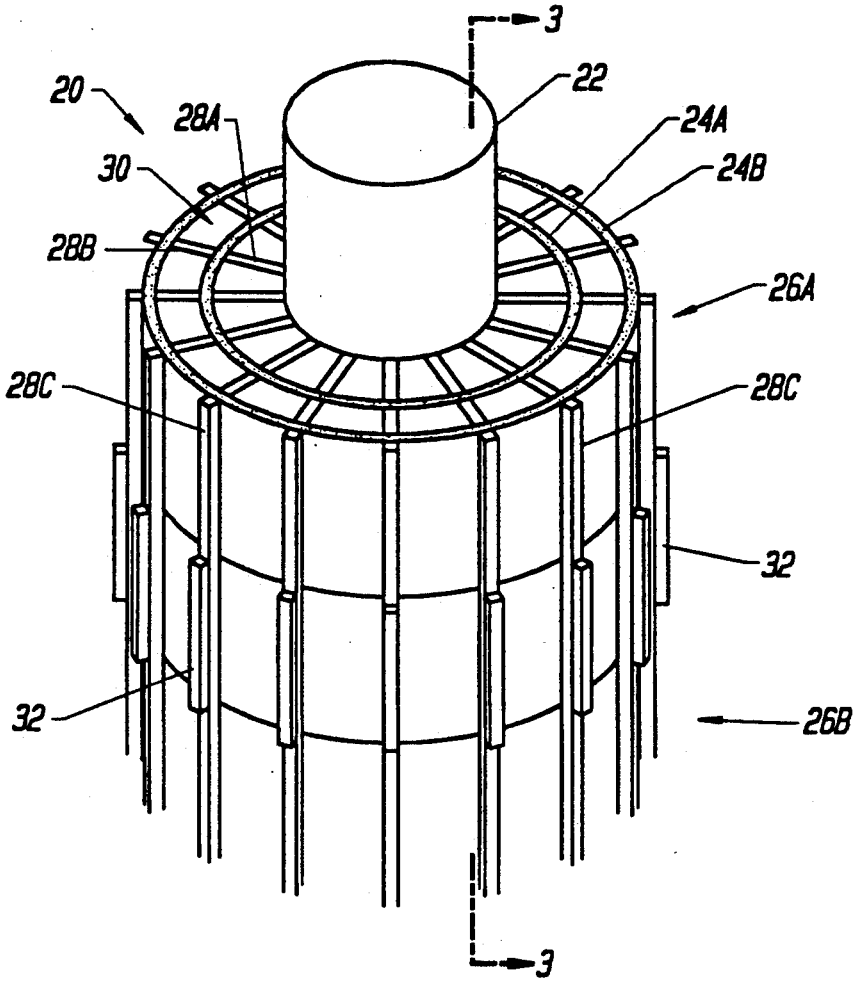
FIG. 1 (PRIOR ART)
FIG. 1 is a perspective view of a portion of a core-form transformer winding in accordance with the prior art.
Figure 2:
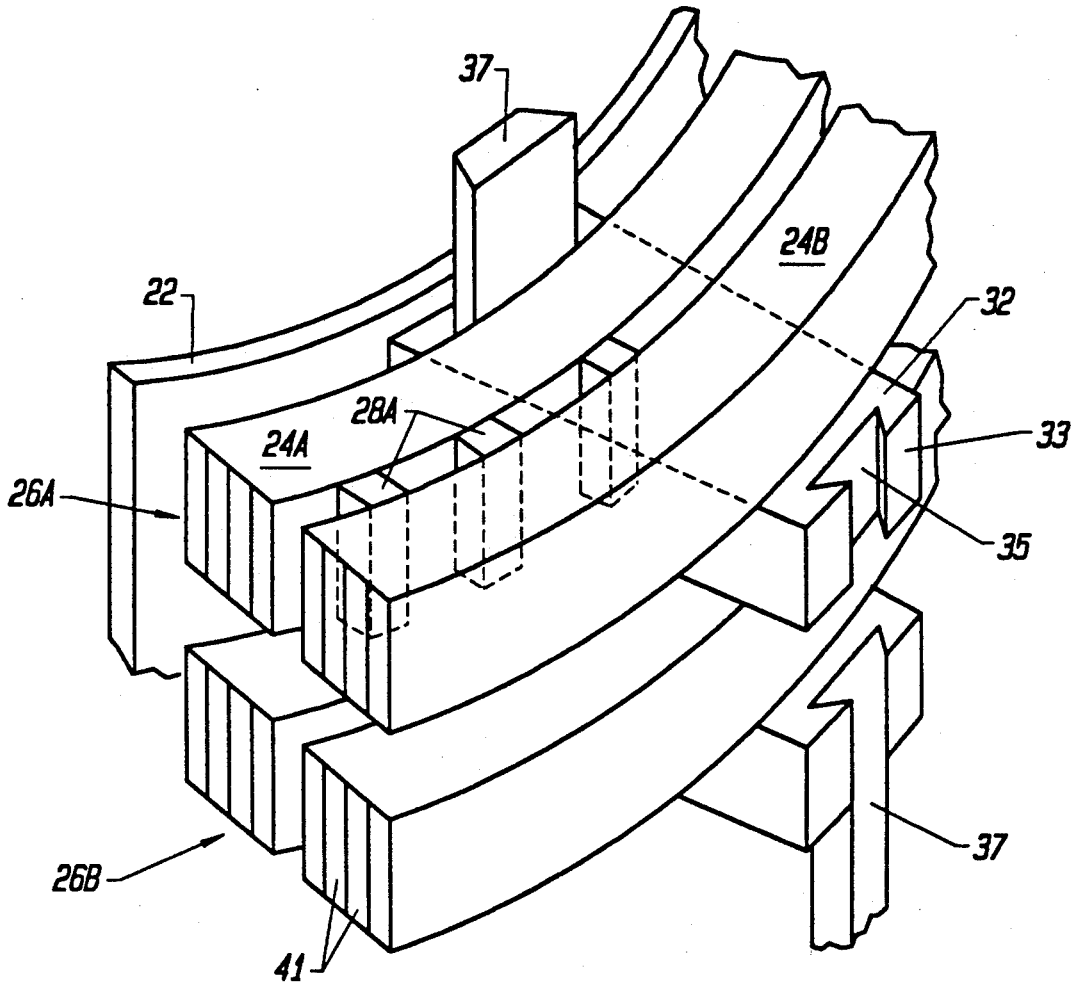
FIG. 2 (PRIOR ART)
FIG. 2 is a perspective view of a portion of the core-form transformer winding of FIG. 1.
Figure 3:
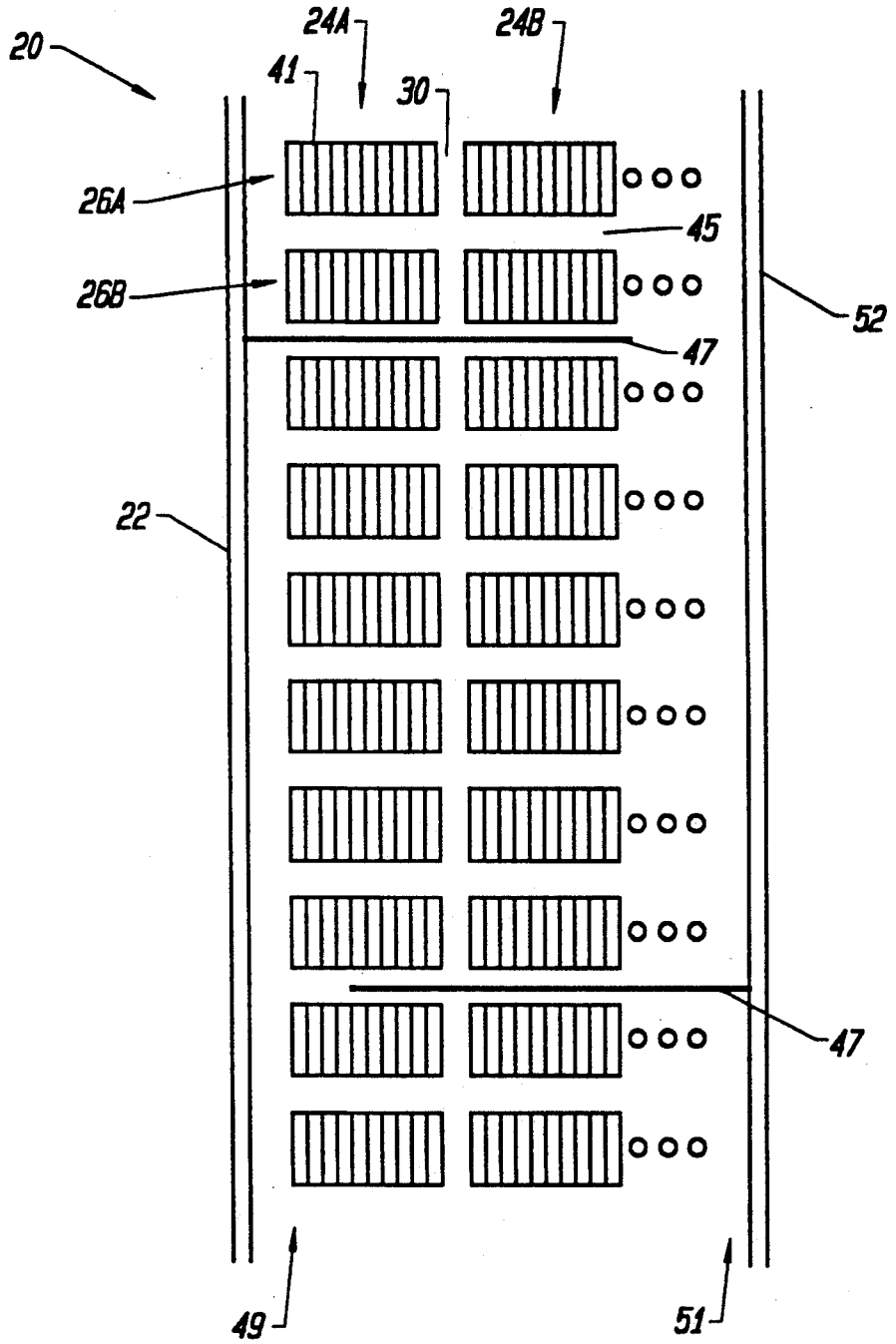
FIG. 3 (PRIOR ART)
FIG. 3 is a sectional view of the core-form winding of FIG. 1, taken along the line 3—3.
Figure 4:
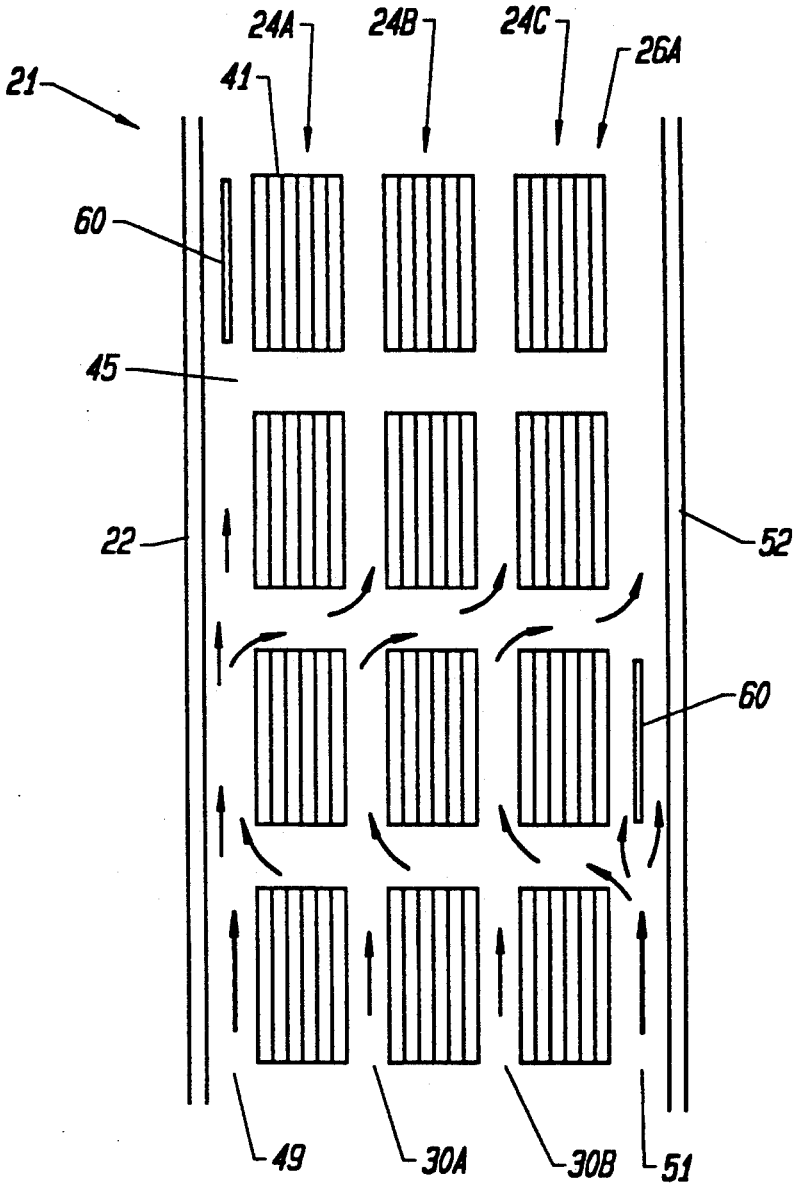
FIG. 4 is a cross-sectional view depicting the liquid coolant flow diversion caused by the flow diversion bands of the present invention.

FIG. 4 is a cross-sectional view of a core-form winding 21 incorporating the flow diversion bands of the present invention. As in the prior art, the core-form winding 21 includes a conductor 41 which is wound into a number of coil segments 24A, 24B, 24C which form a coil section 26A. Instead of the radial barriers 47 used in the prior art, the present invention utilizes flow diversion bands 60.

Each flow diversion band 60 is a strip of material which is formed in a vertical duct. Preferably, flow diversion bands 60 are placed between a coil section 26 and the outer wrap 52, in the outer vertical duct 51. In a preferable embodiment, flow diversion bands 60 are used in conjunction with every second coil section 26. Preferably, the flow diversion bands are approximately the same height as a coil section 26. The thickness of a band 60 is preferably between 1/16 to ½ inch thick, with a preferable thickness of approximately ⅛ of an inch. The band 60 may be formed of electrical grade pressboard.

The arrows in FIG. 4 indicate the liquid coolant flow diversion provided by the bands 60. The bands 60 provide partial blockage of the outer vertical duct 51 at alternate winding sections 26. As indicated in FIG. 4, this causes a portion of the coolant to enter the radial duct 45 and the internal vertical duct 30 below the band. Thus, the partial blockage caused by the bands 60 achieves the desired coolant flow in the radial ducts 45. This flow effectively prevents the temperature of flow in the radial ducts, 45 from getting much hotter than the mean temperature of flow through the inner vertical duct 49, the internal ducts 43, and the outer vertical duct 51. The radial flow caused by the band 60 only needs to be between 7–15%, preferably approximately 10%, of the total flow through the transformer winding 21. One skilled in the art can tailor the size of the band 60 to achieve this flow rate.

Figure 5:
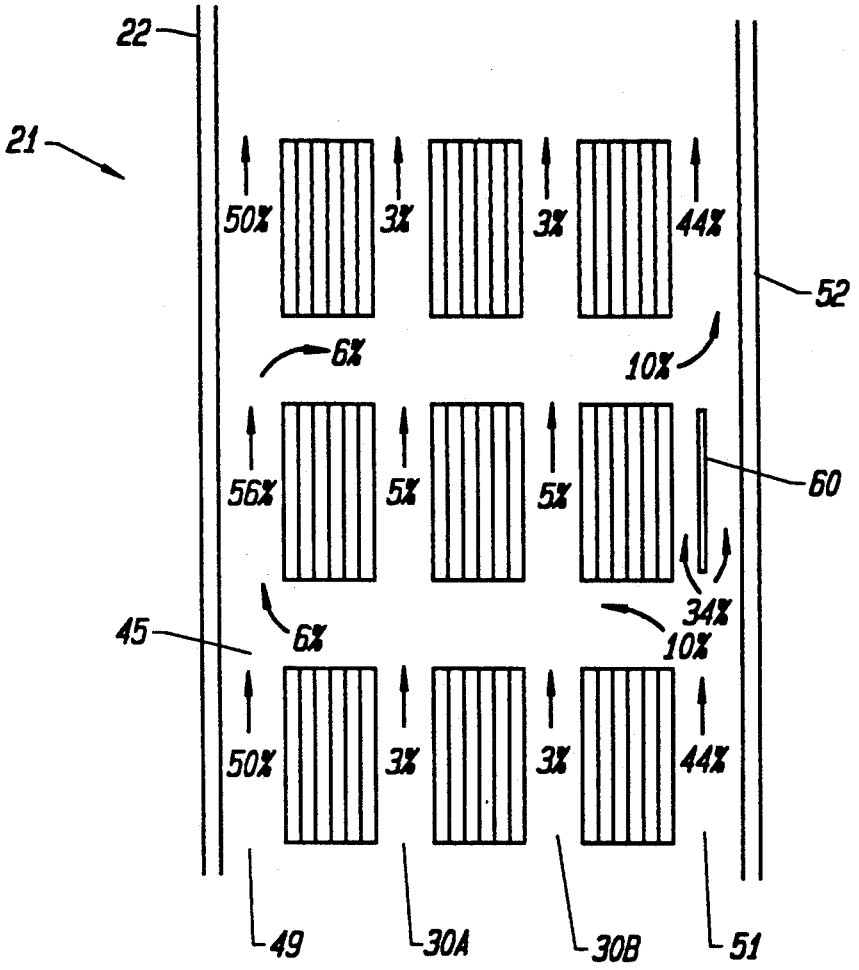
FIG. 5 provides exemplary flow diversion values caused by the flow diversion bands of the present invention.

FIG. 5 depicts a segment of the core-form transformer winding 21 of FIG. 4. The figure provides exemplary flow distribution data in terms of the percentage of total flow. Thus, starting at the bottom of the winding 21, 50% of the coolant flows through the inner vertical duct 49, 3% of the coolant flows through two internal ducts 30,, and 44% of the coolant flows through the outer vertical duct 51. The flow diversion band 60 diverts approximately 10% of the coolant into the radial duct 45. This forces approximately 5% of the coolant through each internal duct 30. This flow diversion also causes the coolant from the internal ducts below the radial duct 45 to be diverted to the inner vertical duct 49, resulting in approximately 56% of the coolant being diverted through the inner vertical duct 49.

Thus, the present invention achieves appropriate coolant flow in the radial ducts 45 of the winding 21. Since only a partial blockage is created by the bands 60, the pressure drop from the bottom of the winding 21 to the top of the winding 21 is less than that experienced in the prior art. Another advantage associated with the invention is that, unlike the radial barriers of the prior art, the bands of the present invention are easy to install, and are therefore less expensive.

Figure 6:
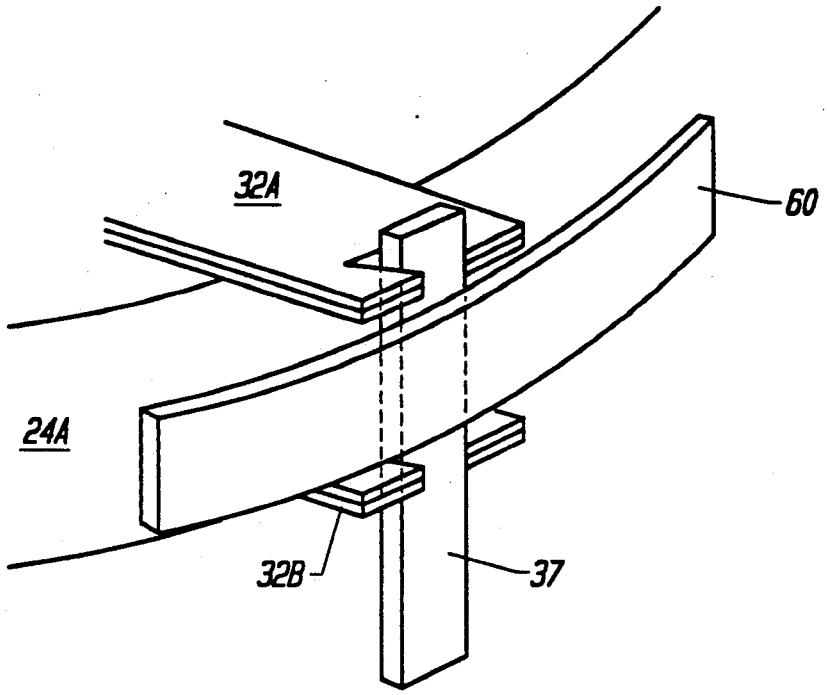
FIG. 6 is an enlarged perspective view depicting the connection of a flow diversion band of the invention to a core-form transformer winding.

Installation of the bands 60 may be accomplished through a variety of techniques. FIG. 6 indicates one technique of installing a flow diversion band 60. In particular, a band 60 is positioned away from coil segment 24N on the outer vertical spacer 37. The axial position of the band 60 is secured by the radial spacers 32A and 32B.

Figure 7:
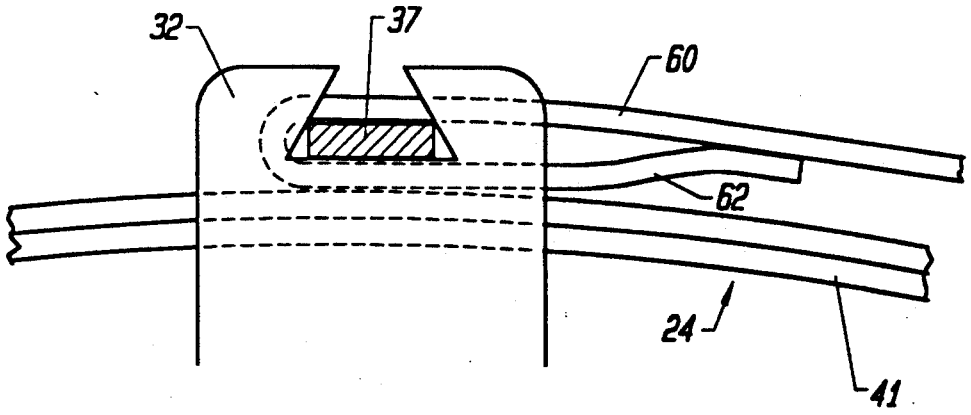
FIG. 7 is a top view of a connection of an end of a flow diversion band of the invention.

FIG. 7 depicts a method of beginning or finishing a band 60. In particular, the figure shows that the band 60 can be wrapped around the outer vertical spacer 37 to form a connecting segment 62. The connecting segment 62 can be coupled to the band 60 with heat bonded plastic bands. A hot glue gun also may be used to dispense adhesive between the connecting segment 62 and the band 60. A transformer-grade string may also be used to tie the connecting segment 62 to the band 60.

The flow diversion bands of the present invention are most successfully applied to advanced transformers which incorporate thin, flat ribbon conductors. Such transformers have fewer coil sections, typically between 30 and 45. On the other hand, the bands 40 may also be successfully applied to conventional transformers which include 60 to 100 coil sections. It should be noted that, for the sake of simplicity, the figures depict between 6 and 10 conductors 41 per coil segment 24, an actual winding will typically include between 15 and 25 conductors per coil segment.

The foregoing descriptions of specific embodiments of the present invention are presented for purposes of illustration and description. They are not intended to be exhaustive or to limit the invention to the precise forms disclosed, obviously many modifications and variations are possible in view of the above teachings. For example, the flow diversion bands 60 may be placed in the inner vertical duct 51, as shown in FIG. 4. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following Claims and their equivalents.

We claim:

1. A core-form transformer winding comprising:

a winding tube including a central longitudinal axis;

a plurality of coil sections axially displaced along said central longitudinal axis of said winding tube, said plurality of coil sections including radial ducts between said coil sections and internal vertical ducts formed within each of said coil sections;

an outer wrap encircling said plurality of coil sections and thereby forming an outer vertical duct between said outer wrap and said plurality of coil sections;

a liquid coolant flowing through said outer vertical duct; and a flow diversion band, with an interior surface and an exterior surface, positioned in said outer vertical duct between said outer wrap and said plurality of coil sections so as to allow said liquid coolant to flow over said interior surface and said exterior surface, said flow diversion band being positioned around a selected coil section of said plurality of coil sections and having an axial length substantially equivalent to the axial length of said selected coil section, said flow diversion band generating a partial blockage of said liquid coolant to form a radial flow into one or more of said radial ducts.

2. The apparatus of claim 1 wherein said radial flow is between 7–15% of the total liquid coolant flow between said winding tube and said outer wrap.

3. The apparatus of claim 1 further comprising radial spacers positioned between said plurality of coil sections and outer vertical spacers positioned at the outer circumference of said plurality of coil sections, said radial spacers and said vertical spacer supporting said flow diversion band.

4. In a core-form transformer including a winding tube with a central longitudinal axis, and a plurality of circumferential coil sections axially displaced along said central longitudinal axis of said winding tube, each of said plurality of coil sections including an outer perimeter and a plurality of internal vertical ducts, said axially displaced coil sections defining radial ducts between said coil sections, the improvement comprising:

a coolant flow diversion band positioned between said outer wrap and said outer perimeter of a selected coil section of said plurality of coil sections so as to allow coolant to simultaneously flow along interior and exterior surfaces of said coolant flow diversion band, said coolant flow diversion band having an axial length substantially equivalent to the axial length of said selected coil section and generating a radial flow to divert liquid coolant into said radial ducts between said coil sections.

5. The apparatus of claim 4 wherein said radial flow is between 7–15% of the total liquid coolant flow passing said plurality of coil sections.

6. The apparatus of claim 4 further comprising radial spacers positioned between said plurality of coil sections and outer vertical spacers positioned outside of said outer perimeter of said plurality of coil sections, said radial spacers and said vertical spacers supporting said coolant flow diversion band.

7. In a core-form transformer including a winding tube with a central longitudinal axis, and a plurality of circumferential coil sections axially displaced along said central longitudinal axis of said winding tube, each of said plurality of coil sections including an inner perimeter and a plurality of internal vertical ducts, said axially displaced coil sections defining radial ducts between said coil sections, the improvement comprising:

a coolant flow diversion band positioned within said inner perimeter of a selected coil section of said plurality of coil sections so as to allow coolant to simultaneously flow along interior and exterior surfaces of said coolant flow diversion band, said coolant flow diversion band having an axial length substantially equivalent to the axial length of said selected coil section and generating a radial flow to divert liquid coolant into said radial ducts between said coil sections.

8. The apparatus of claim 7 wherein said radial flow is between 7–15% of the total liquid coolant flow passing said plurality of coil sections.

9. The apparatus of claim 7 further comprising radial spacers positioned between said plurality of coil sections and inner vertical spacers positioned between said winding tube and said inner perimeter of said plurality of coil sections, said radial spacers and said inner vertical spacers supporting said coolant flow diversion band.

* * * * *